US007992329B2

(12) United States Patent
Horton

(10) Patent No.: US 7,992,329 B2
(45) Date of Patent: Aug. 9, 2011

(54) SINGLE POINTED RIPPER BUCKET EXCAVATION TOOL

(76) Inventor: Lee A. Horton, Jefferson, MA (US)

( * ) Notice: Subject to any disclaimer, the term of this patent is extended or adjusted under 35 U.S.C. 154(b) by 0 days.

(21) Appl. No.: 12/882,820

(22) Filed: Sep. 15, 2010

(65) Prior Publication Data

US 2011/0000108 A1 Jan. 6, 2011

Related U.S. Application Data

(63) Continuation of application No. 11/776,966, filed on Jul. 12, 2007, now abandoned, application No. 12/882,820, which is a continuation-in-part of application No. 11/735,117, filed on Apr. 13, 2007, now Pat. No. 7,739,815, which is a continuation-in-part of application No. 11/214,607, filed on Aug. 29, 2005, now Pat. No. 7,322,133, which is a continuation-in-part of application No. 10/762,733, filed on Jan. 22, 2004, now abandoned.

(60) Provisional application No. 60/834,865, filed on Aug. 1, 2006, provisional application No. 60/631,525, filed on Nov. 29, 2004, provisional application No. 60/442,031, filed on Jan. 23, 2003.

(51) Int. Cl.
*E02F 3/40* (2006.01)

(52) U.S. Cl. ..... 37/444; 37/404; 37/379; 37/452

(58) Field of Classification Search ..... 37/404–407, 37/444, 403, 468, 379, 452, 453
See application file for complete search history.

(56) References Cited

U.S. PATENT DOCUMENTS

| | | | | | |
|---|---|---|---|---|---|
| 2,615,262 | A | | 10/1952 | Reid, Sr. | |
| 2,660,323 | A | | 11/1953 | Carlesimo | |
| 2,838,856 | A | * | 6/1958 | Buisse | 37/404 |
| 2,864,184 | A | * | 12/1958 | Fohr | 37/404 |
| 2,972,425 | A | * | 2/1961 | Anderson et al. | 37/379 |
| 3,000,120 | A | * | 9/1961 | Larue et al. | 37/379 |
| 3,130,843 | A | * | 4/1964 | Kelly | 37/444 |
| 3,307,277 | A | * | 3/1967 | Kondracki | 37/450 |

(Continued)

FOREIGN PATENT DOCUMENTS

FR 2435562 A * 5/1980

(Continued)

OTHER PUBLICATIONS

"Couplers and Attachments for Construction Equipment"; *DigNRipBucket*; Leading Edge Attachments, Inc.; 2002-2004.

(Continued)

*Primary Examiner* — Thomas Beach
*Assistant Examiner* — Matthew R Buck
(74) *Attorney, Agent, or Firm* — Fish & Richardson P.C.

(57) ABSTRACT

A single pointed ripper bucket excavation tool (SPRB) for use mounted to an arm of an excavation machine has a body mounted for rotation from the arm and a pair of generally flat, side plates mounted to the body and narrowing from a first width in a region of the body to a second, relatively smaller width at a tip region spaced from the body. A single ripper tooth is mounted in the tip region of the ripper bucket. One or more plates are mounted to span a region between the side plates, rearward of the ripper tooth in a direction of ripping motion, to define, with the side plates, a ripper bucket volume for receiving material ripped from the substrate during ripping motion.

4 Claims, 18 Drawing Sheets

U.S. PATENT DOCUMENTS

| | | | | | |
|---|---|---|---|---|---|
| 3,724,899 | A | | 4/1973 | Clark | |
| 3,792,539 | A | * | 2/1974 | Clark | 37/448 |
| 3,885,833 | A | * | 5/1975 | Lemieux | 299/36.1 |
| 3,958,347 | A | * | 5/1976 | Heitman | 37/379 |
| 4,037,337 | A | * | 7/1977 | Hemphill | 37/444 |
| 4,038,766 | A | | 8/1977 | Felstet | |
| 4,041,624 | A | | 8/1977 | Fryrear | |
| 4,043,061 | A | * | 8/1977 | Heitman | 37/448 |
| 4,077,529 | A | | 3/1978 | Leyrat et al. | |
| 4,117,611 | A | * | 10/1978 | Hemphill | 37/452 |
| 4,123,861 | A | * | 11/1978 | Hemphill | 37/195 |
| 4,133,121 | A | * | 1/1979 | Hemphill | 37/444 |
| 4,204,348 | A | | 5/1980 | Lydie | |
| 4,217,962 | A | | 8/1980 | Schaefer | |
| 4,238,896 | A | | 12/1980 | Lanz et al. | |
| 4,279,085 | A | | 7/1981 | Arnold | |
| 4,314,789 | A | * | 2/1982 | Luigi | 414/694 |
| 4,321,762 | A | | 3/1982 | Hemphill | |
| 4,351,397 | A | | 9/1982 | Winker | |
| 4,457,085 | A | | 7/1984 | Arnold | |
| 4,476,641 | A | * | 10/1984 | Ballinger | 37/444 |
| 4,516,339 | A | | 5/1985 | Hemphill | |
| 4,576,239 | A | | 3/1986 | Launder | |
| 4,616,433 | A | * | 10/1986 | Knell et al. | 37/452 |
| 4,691,455 | A | * | 9/1987 | Newman | 37/443 |
| 4,704,811 | A | * | 11/1987 | Jefferson | 37/364 |
| 4,719,711 | A | * | 1/1988 | Sieber et al. | 37/444 |
| 4,808,027 | A | | 2/1989 | Anderson | |
| 4,845,867 | A | * | 7/1989 | Albrecht | 37/406 |
| 4,896,444 | A | * | 1/1990 | Sieber et al. | 37/444 |
| RE33,198 | E | * | 4/1990 | Ballinger | 37/444 |
| 5,084,990 | A | | 2/1992 | Briscoe | |
| 5,212,897 | A | * | 5/1993 | Jefferson | 37/403 |
| 5,350,022 | A | | 9/1994 | Launder et al. | |
| 5,456,028 | A | | 10/1995 | Larson | |
| 5,815,959 | A | * | 10/1998 | Bahner et al. | 37/444 |
| 5,901,479 | A | * | 5/1999 | Langdon | 37/444 |
| 5,992,062 | A | | 11/1999 | Evans et al. | |
| 6,287,072 | B1 | * | 9/2001 | Wasilas | 414/729 |
| 6,328,114 | B1 | | 12/2001 | Ritchie et al. | |
| 6,581,308 | B1 | * | 6/2003 | Woerman et al. | 37/444 |
| 6,626,499 | B1 | | 9/2003 | Schenk et al. | |
| D553,162 | S | * | 10/2007 | Cazes | D15/32 |
| 7,617,619 | B2 | * | 11/2009 | Cox | 37/406 |
| 2004/0060208 | A1 | * | 4/2004 | Wagner | 37/452 |
| 2006/0070267 | A1 | | 4/2006 | Horton | |
| 2009/0183398 | A1 | * | 7/2009 | McClallen et al. | 37/444 |

FOREIGN PATENT DOCUMENTS

| | | | | |
|---|---|---|---|---|
| JP | 04024332 | A | * | 1/1992 |
| JP | 2002038518 | A | * | 2/2002 |

OTHER PUBLICATIONS

"Wain Roy™ Ripper Bucket™"; Woods Equipment Company; 1998.
Wain-Roy® Ripper Bucket™ for Severe Digging; Wain Roy® Inc.

* cited by examiner

SINGLE POINTED RIPPER BUCKET EXCAVATION TOOL

This application is a continuation (and claims the benefit of priority under 35 U.S.C. 120) of U.S. patent application Ser. No. 11/776,966, filed Jul. 12, 2007 now abandoned, which claims benefit from U.S. Provisional Patent Application No. 60/834,865, filed Aug. 1, 2006. The application is also a continuation-in-part of U.S. patent application Ser. No. 11/735,117, filed Apr. 13, 2007, now U.S. Pat. No. 7,739,815, which is a continuation-in-part of U.S. patent application Ser. No. 11/214,607, filed Aug. 29, 2005, now U.S. Pat. No. 7,322,133, which claims benefit from U.S. Provisional Patent Application No. 60/631,525, filed Nov. 29, 2004, now abandoned, and which is also a continuation-in-part of U.S. patent application Ser. No. 10/762,733, filed Jan. 22, 2004, now abandoned, which claims benefit from U.S. Provisional Application No. 60/442,031, filed Jan. 23, 2003, now abandoned. The complete disclosures of all of these applications are incorporated herein by reference.

TECHNICAL FIELD

This invention relates to excavation tools, and more particularly to ripper-and-bucket type excavation tools.

BACKGROUND

Excavation tools of the types described herein are typically mounted to conventional excavators of the type having a backhoe. The backhoe includes a dipper stick, and the tool is mounted on the outboard end of the dipper stick. The tools are employed for excavation of difficult-to-excavate intermediate substrate, e.g. substrate between the category of loose soil or loose gravel and the category of solid rock. Intermediate substrate requires special tools to be excavated efficiently. Loose soil or gravel can be excavated with a conventional bucket, but a conventional bucket is generally not effective in intermediate substrate. Solid rock excavation generally requires a hydraulic hammer, but a hydraulic hammer is not efficient for excavating intermediate substrate. Attempts have been made to develop tools that are effective and efficient in excavating intermediate substrate. Simply stated, there have been three general approaches, i.e. the single tooth approach; the added articulated tooth approach, in which a tooth is positioned behind the bucket; and the multi-tooth bucket approach, where several teeth are mounted on the back side of the bucket, e.g. as described in Arnold U.S. Pat. No. 4,279,085 and Arnold U.S. Pat. No. 4,457,085. Each of these approaches has been found to have drawbacks and none is efficient and effective for excavation of intermediate substrate.

Other prior art tools include the single pointed ripper (SPR, shown in FIG. 12), which has been around for a long time. It is used for ripping rock and frost, and is very effective because it focuses all of the breakout force on one tooth. Also, while it is relatively smaller and inexpensive, and does the job, it is very slow. (The Multi-Ripper™, Multi-Ripper Bucket™ and DigNRip™ excavation tools, from Leading Edge Attachments, Inc., of Jefferson, Mass., e.g. the latter as shown in FIG. 13, are superior to the SPR because there are three shanks on an arc that focus the breakout force on one tooth at a time, but are more costly.) The SPR usually has an upper structure that is wider than the arm and connects to the linkage of an excavator or backhoe, and a bottom structure formed of a solid slab of steel, making a shank, and a replaceable tooth mounted at the end. The trench made by ripping with the SPR is v-shape because once a predetermined depth is attained, the upper structure interferes with side walls of the trench and the operator is forced to move laterally to clear the sides. After the trench is ripped in the v-shape, the operator changes tools or uses another machine equipped with a bucket to clean the ripped trench of the ripped debris. Since most buckets dig a trench having a flat bottom with bottom corners, the ripped trench has to be at least as wide as the operator's narrowest bucket. Almost all of the forms of SPR available on the market are considerably longer than the standard tip radius of a bucket due to the fact that the ripper is in the center of the top structure, and the top structure hits the sides of the trench. Operators typically look for longer rippers capable of ripping the sides of the trench without having to move laterally. Unfortunately, when the length of a ripper is increased, the breakout force is reduced. The SPR is also favored by operators for prying out boulders, stumps and layers of hard rock formations by wedging the tip under the part to be removed and applying down pressure with the machine. Existing ripper bucket combinations typically do not have a shape that easily allows this function.

The trapezoidal "V" bucket (TVB, shown in FIGS. 14 and 15) is constructed somewhat similarly to the SPR bucket except there are at least two teeth on the bottom horizontal lip and the bucket is considerably wider at the top and bottom. The side leading edges are straight, and the bottom tapers upward quickly. The TVB is generally a light duty bucket used for digging drainage ditches through softer, non-rock materials. There are also versions of the TVB with no teeth (shown in FIGS. 16A and 16B), specifically for digging v-shape trenches through soft dirt. The TVB bucket is not structurally designed for ripping rock or prying.

The cribbing bucket (CB, shown in FIG. 17) is a very narrow bucket construction designed for replacing railroad ties. The long, narrow shape allows the bucket to push the railroad ties from beneath the track. The CB has at least two teeth, and the bucket construction is not in a v-shape. The sides are nearly parallel, and the CB bucket is not structurally designed for ripping or prying.

The strata "V" rock bucket (SVRB, shown in FIG. 18), also known as the Adco "V" bucket, is a v-shape bucket with teeth mounted on the v-shape leading edge, and vertical sides connecting the v-shape leading edges to the upper structure of the bucket. The SVRB is designed for ripping rock; however, the rip radius is long, and as the bucket digs deeper into the rock trench, more and more teeth begin sharing the load, so that the ripping ability is compromised. Many SVRB buckets were sold because operators liked to rip v-shape bottom trenches in the rock for laying utilities, because it saved them from having to rip the rock from the corners of the trench and then backfill material into the corners after the utility line was laid, resulting in savings of time for digging and backfilling. The SVRB bucket eliminates ripping of the bottom corners of the trench; however, the ripping ability is very poor due to a long tip radius and the engagement of multiple teeth at one time. The structure of the SVRB bucket also does not facilitate prying, and it is very expensive because the design requires special cast angle adapters suitable only for the one purpose.

SUMMARY

The single pointed ripper bucket of this disclosure is a new style ripper/bucket combination primarily for use by excavators and backhoes. It allows an operator to easily rip rock, coral shale, caliche, decomposed granite, limestone, sandstone, asphalt and frozen ground with maximum breakout force, pry out and carry stumps or boulders, rip a clean, narrow v-shape trench for laying utilities, plus scoop and load material.

According to the disclosure, a single pointed ripper bucket excavation tool (SPRB) for use mounted to an arm of an excavation machine comprises a body mounted for rotation from the arm, a pair of generally flat, side plates mounted to the body and narrowing from a first width in a region of the body to a second, relatively smaller width at a tip region spaced from the body, a single ripper tooth mounted in the tip region of the ripper bucket, and one or more plate members mounted to span a region between the side plates, rearward of the ripper tooth in a direction of ripping motion, and defining, with the side plates, a ripper bucket volume for receiving material ripped from the substrate during ripping motion.

Preferred embodiments of the disclosure may include one or more of the following additional features. The ripper tooth is replaceably mounted to the ripper bucket. The ripper tooth comprises a nosepiece adapter. The ripper tooth terminates in a tip, and the ripper tooth is disposed at a predetermined angle measured rearward from the line between the tooth tip and the bucket arm pivot. Preferably, the predetermined angle is in a range of between about 30° and about 70°. The ripper tooth is selected from the group consisting of: single point teeth and multiple point teeth. The ripper tooth is a double point ripper tooth having a first ripper tooth portion and a second ripper tooth portion, the first ripper tooth portion being angularly advanced relative to the second ripper tooth portion in a general direction of substrate ripping motion, whereby the first ripper tooth tip is engaged for ripping the substrate before the second ripper tooth tip is engaged for ripping the substrate. The ripper bucket defines a bottom surface generally following a curve having its center near the ripper bucket arm pivot. The side plates define front leading edges that curve in an upward concave shape angled rearwardly, away from the arm pivot radial centerline. The arm is a dipper arm or a boom arm. Unless otherwise defined, all technical and scientific terms used herein have the same meaning as commonly understood by one of ordinary skill in the art to which this disclosure belongs. Although methods and materials similar or equivalent to those described herein can be used in the practice or testing of the present disclosure, suitable methods and materials are described below. All publications, patent applications, patents, and other references mentioned herein are incorporated by reference in their entirety. In case of conflict, the present specification will control. In addition, the materials, methods, and examples are illustrative only and not intended to be limiting. Other features and advantages will be apparent from the following detailed description, and/or from the claims.

DESCRIPTION OF DRAWINGS

Like reference symbols in the various drawings indicate like elements.

DETAILED DESCRIPTION

Figure 1:
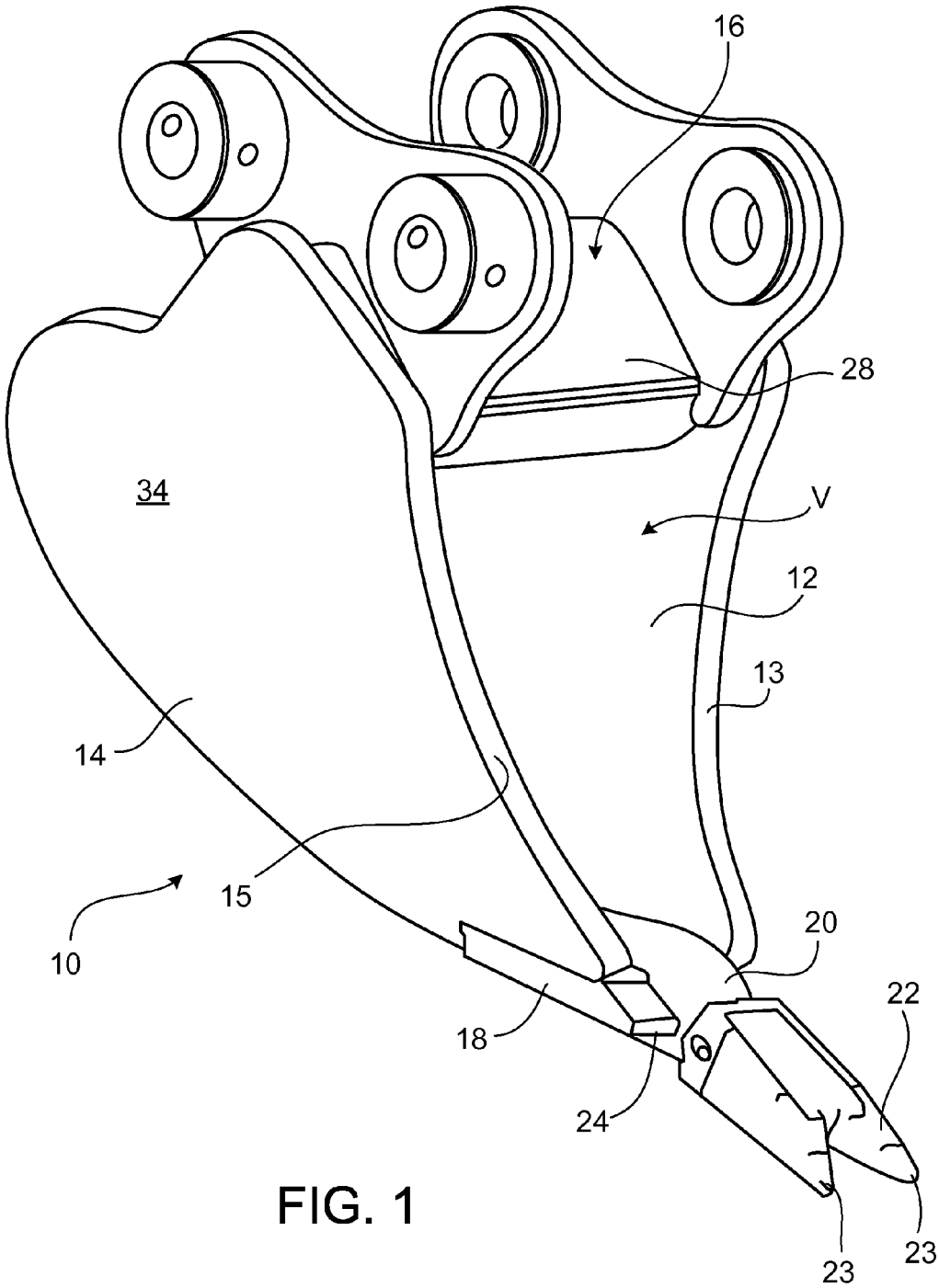
FIG. 1 is a front perspective view of a single pointed ripper bucket of the disclosure.
Figure 2:
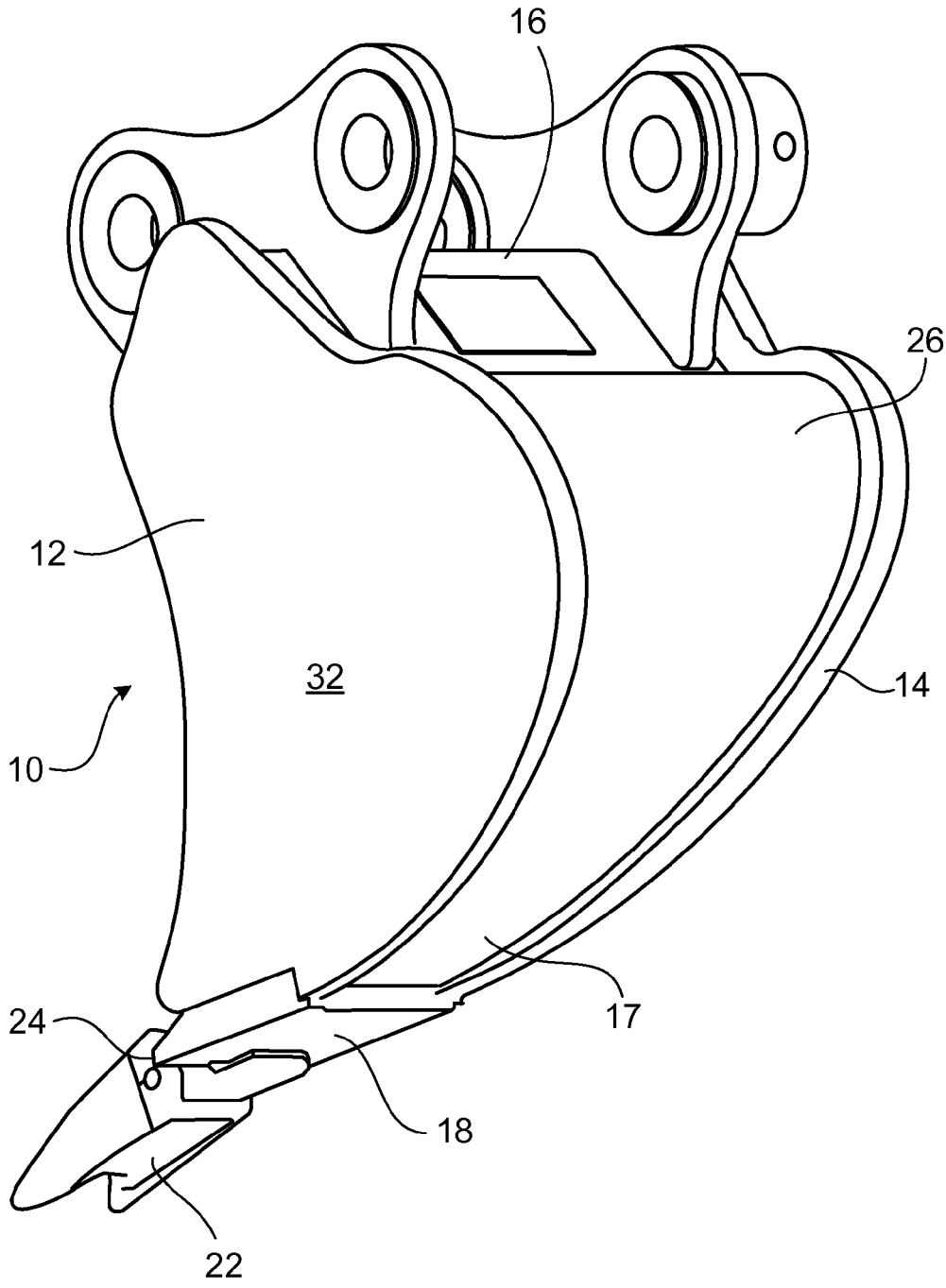
FIG. 2 is a rear perspective view of the single pointed ripper bucket of FIG. 1.
Figure 3:
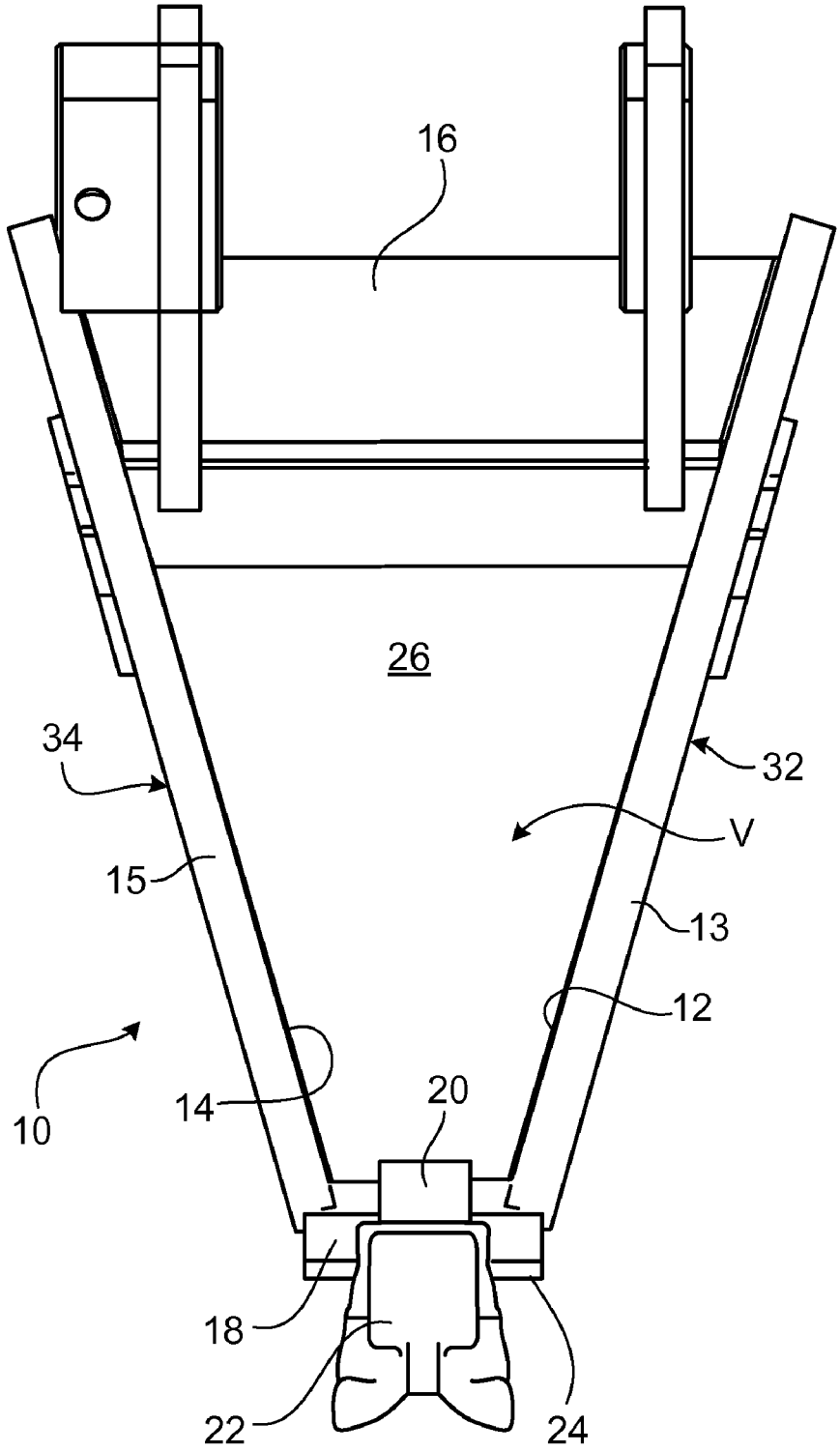
FIG. 3 is a front view of the single pointed ripper bucket of FIG. 1.
Figure 4:
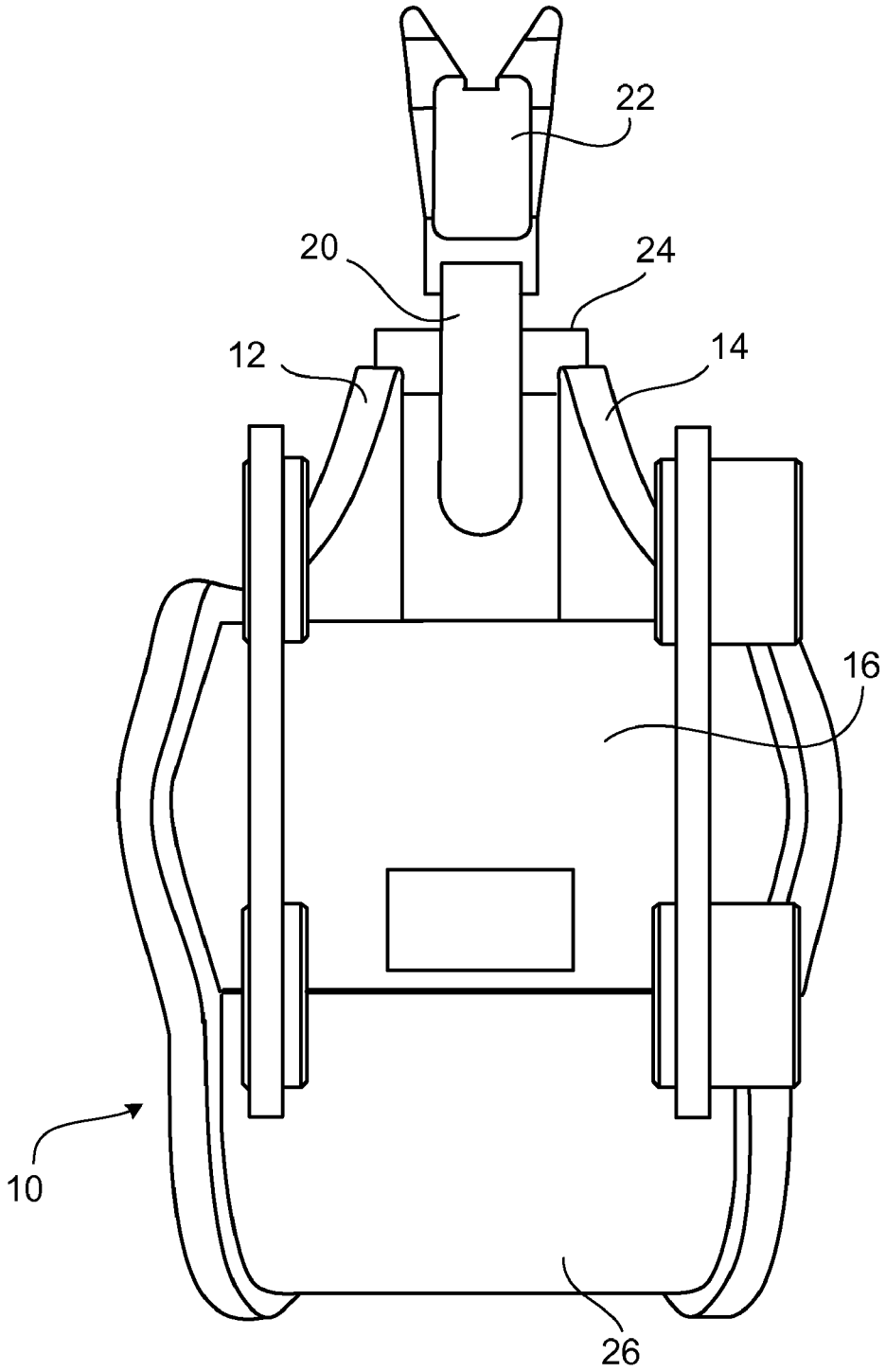
FIG. 4 is a top view of the single pointed ripper bucket of FIG. 1.

Referring to FIGS. 1-11, a single pointed ripper bucket (SPRB) 10 is a new construction that allows an operator to own a relatively inexpensive single pointed ripper while simultaneously allowing the operator to scoop and remove ripped debris without requiring a tool change or machine change to use of another bucket. The side plates 12, 14 of the single pointed ripper bucket 10 are solid, high strength steel slabs arranged in a v-shape, relatively wide in the region of the body 16, and converging at the bottom 17 (FIG. 2), where they are connected by a structural member 18, which is welded to a tooth adapter 20 holding a single replaceable tooth 22. The structural member 18 can define a horizontal leading edge 24 that carries a conventional tooth adapter 20, e.g. as shown in the drawings, or it can be a vertical curved shank that adapts to a weld-on nose piece, which, in turn, holds the replaceable tooth 22. In either case, a curved back-sheet 26 closes the back and bottom of the ripper bucket 10, thus forming a bucket volume, V, of predetermined capacity. The width of the ripper bucket 10 in the region of the body 16 is typically only wide enough to be wider than the arm or dipper-stick (not shown), and to allow a horizontal cross tube structure 28 that is attached to the excavator or backhoe linkage or coupler connection. The tip radius of the single pointed ripper bucket 10 is shorter than a standard bucket, which helps keep the breakout forces high, but the ripper bucket 10 is also sufficiently long enough to form a v-shape that is structurally sound for ripping and prying.

Many utility contractors want to bury utility lines, pipes and cables without having to rip rectangular-shape trenches through rock, and then have to backfill the displaced material after laying the utility line. Using a single-pointed ripper bucket 10 of the disclosure, an operator can rip a narrow v-shape trench, allowing the utility to be laid in the bottom of the trench, and minimizing the handling of backfill material. In locations where rock bedding is required, the quantity of required bedding material is reduced, due to the very narrow trench bottom.

Figure 12:
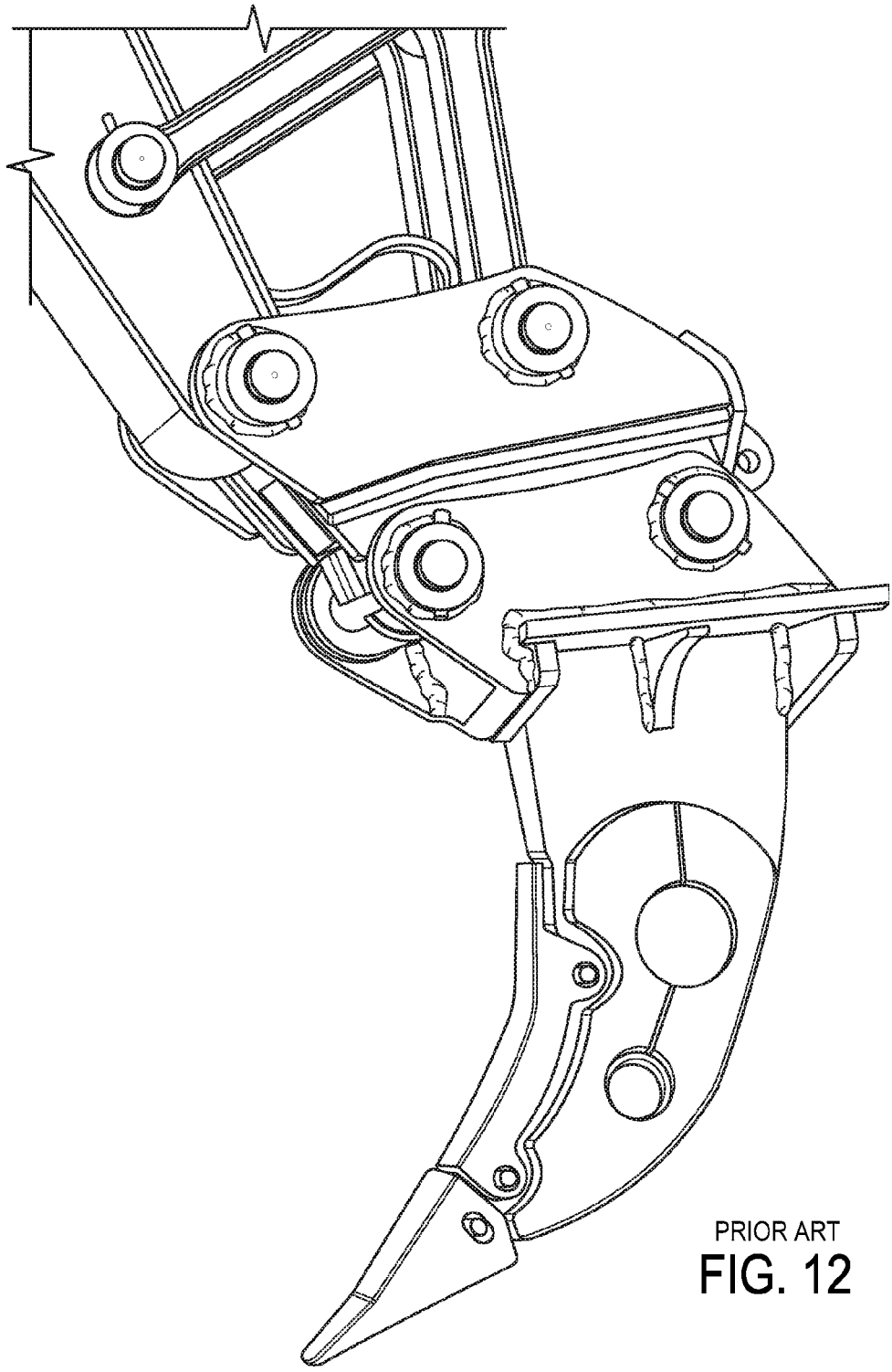
PRIOR ART FIG. 12
FIG. 12 is a side perspective view of a prior art single pointed ripper (SPR).
Figure 13:
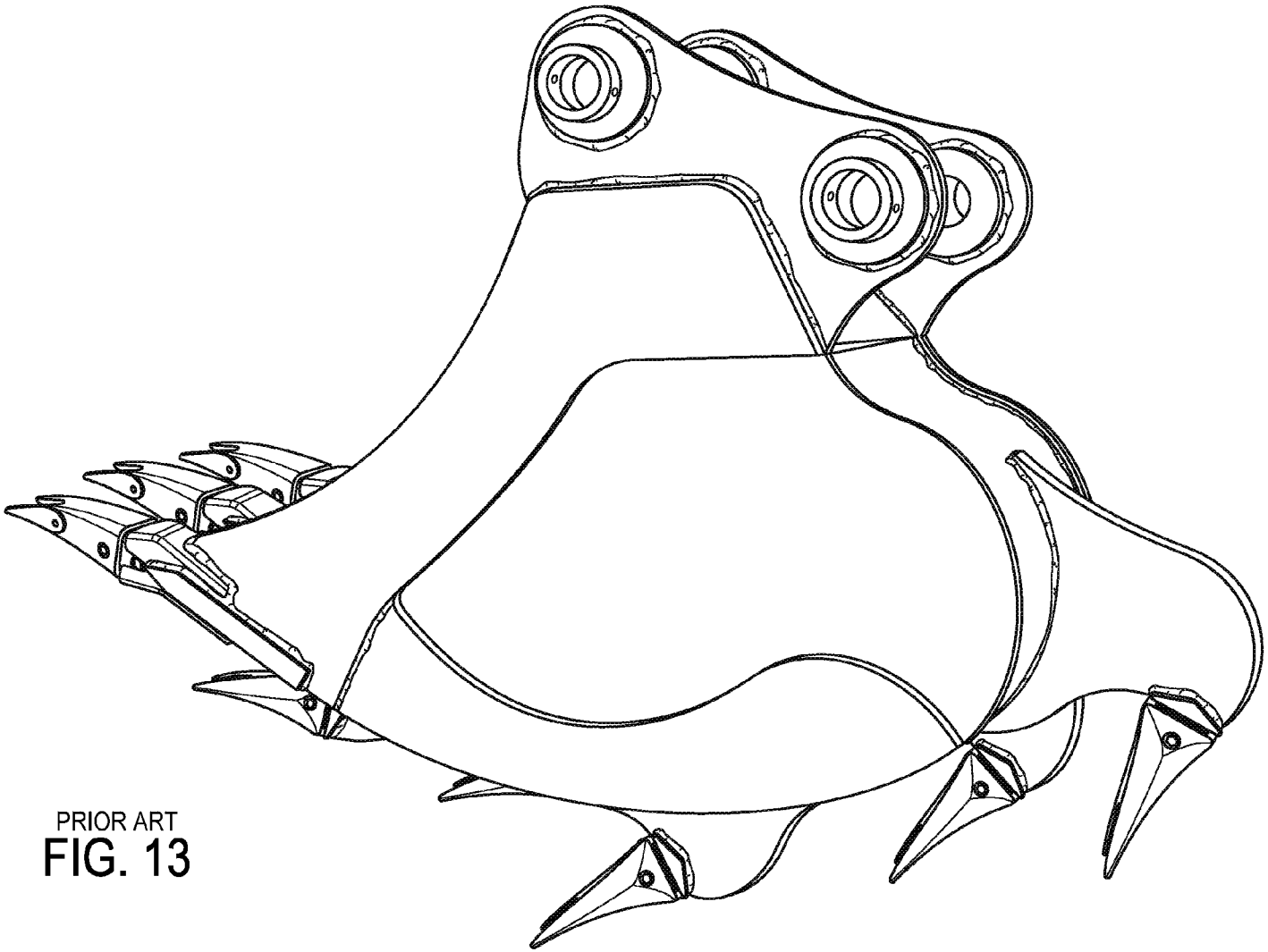
PRIOR ART FIG. 13
FIG. 13 is a side perspective view of a prior art multiple ripper bucket, i.e. the DigNRip™ bucket from Leading Edge Attachments, Inc.
Figure 14:
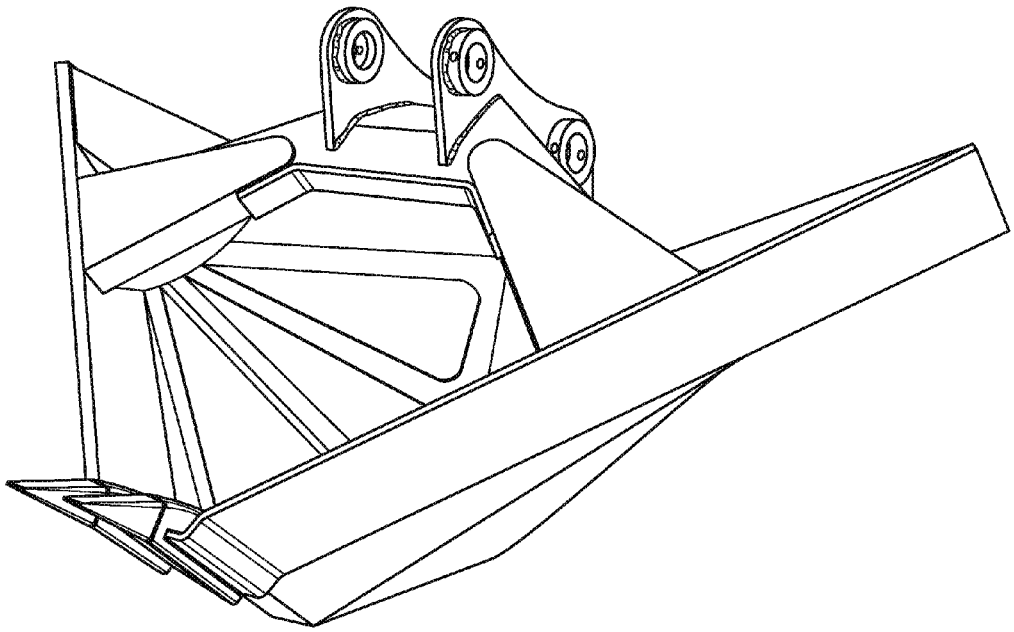
PRIOR ART FIG. 14
FIG. 14 is a front perspective view of a prior art trapezoidal "V" ditching bucket (TVB) with teeth.

The single pointed ripper bucket 10 also facilitates prying of stumps, boulders and flat rock slab formations that can be pried with existing single pointed rippers (e.g., as shown in FIG. 12), but which cannot be pried with existing ripper/bucket combinations.

Figure 5:
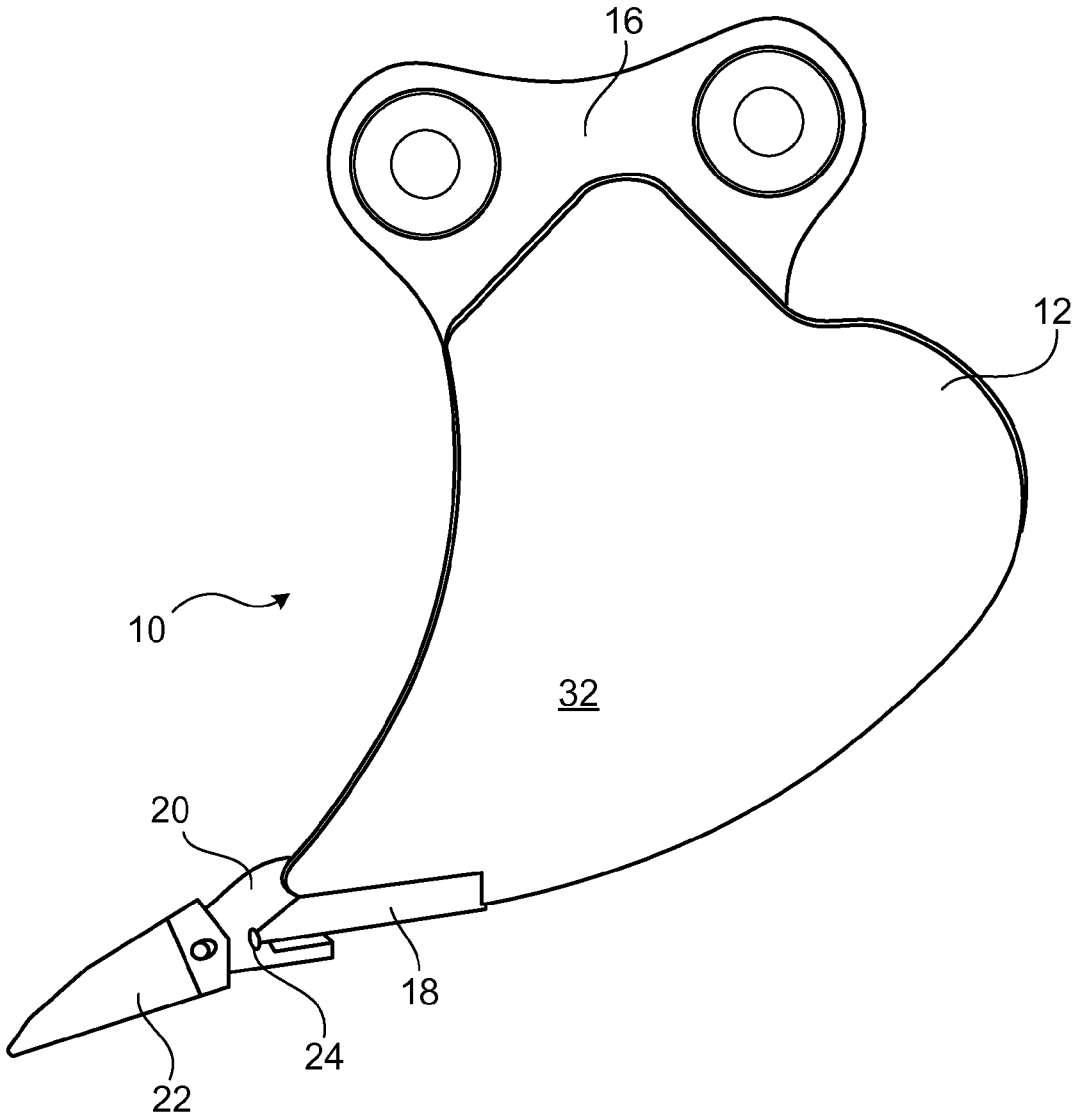
FIG. 5 is a side view of the single pointed ripper bucket of FIG. 1.

Since rock fractures at an upward angle, after the rock is ripped with the tooth, the rough sides that are produced leave protruding irregular shaped rock patterns which are then broken off by the following side leading edges 13, 15 of the single pointed ripper bucket 10. As best seen in FIG. 5, these side leading edges are curved and angled rearwardly, away from the arm pivot radial centerline, so that the debris material is displaced upward, thus leaving a relatively clean angle trench wall. As the side leading edges 13, 15 of the ripper bucket 10 displace the protruding edges of rock upward, the outer side wall surfaces 32, 34 of the side plates 12, 14, respectively, act like an upward wedge, providing some additional mechanical advantage, e.g. as compared to vertical side walls that typically extend somewhat parallel to the radial line from the arm pivot center. The side leading edges 13, 15, of the single pointed ripper bucket 10 are angled advantageously and displace the material upwards to eject it, e.g. as opposed to vertical side leading edges typical of competing products, which displace the material side to side, thus causing a binding effect. (A useful comparison can be made between the force required to cut through a tough material with a knife held perpendicular to the material as compared to the relatively smaller force required to drag the knife through the material at an angle with the point of the knife forward of the handle.) The typical cutting angle of the single pointed ripper bucket 10 causes an upward displacement of the ripped material (instead of binding the material) by displacing the material side to side. Displacing the material upwards thus advantageously allows a smoother ripping effect. The curved side leading edges 13, 15 also permit the operator to cradle and carry large boulders and stumps.

Other advantages of the single pointed ripper bucket 10 of the disclosure will now be described.

The combination of applying the full breakout force through one tooth 22 and relatively shorter length, e.g. as compared to a standard SPR (e.g., as shown in FIG. 12), provides relatively greater breakout force with the single pointed ripper bucket 10.

The curved shape and narrow width of the single pointed ripper bucket 10 facilitates prying to a degree not found with other ripper/bucket combinations.

The single pointed ripper bucket 10 rips a minimum amount of rock and other material by not requiring ripping of the bottom corners of the trench, e.g. as compared to ripping a square shaped trench bottom, thereby reducing the amount of rock necessary to be ripped, e.g. for utility contractors laying cables or pipes in rock.

The single pointed ripper bucket 10 also reduces the amount of backfilling by making it unnecessary to backfill corners of the trench.

The single pointed ripper bucket 10 shapes the sides of the v-shape trench by scraping the angled side surfaces 32, 34 of the ripper bucket 10 against the ripped side walls of the trench, thus creating a clean, uniform v-shape ripped trench, e.g. as compared to a single pointed ripper that leaves the sides in rough condition.

Stump ripping can be easier with an single pointed ripper bucket 10, e.g. as compared to using a conventional bucket or SPR (e.g., as shown in FIG. 12), because the narrow shape of the single pointed ripper bucket 10 makes it easier to rip stump roots by displacing less dirt, and the side leading edges 13, 15 make it easier to grab and hold the stump for pulling and carrying.

The relatively wider, curved, cupping shape of the single pointed ripper bucket 10 offers more support for trapping items between the ripper bucket 10 and the machine arm or thumb when cradling rocks and stumps.

The bucket volume, V, of the single pointed ripper bucket 10 fills and empties easily, permitting the operator to scoop materials such as rock, coral shale, caliche, decomposed granite, limestone, sandstone, and other non-sticky materials, e.g. for scooping and cleaning out ripped rock debris.

The effective ripper/bucket combination offered by the SPRB 10 of the disclosure is typically considerably less expensive than other ripper/bucket combination products on the market.

Figure 6:
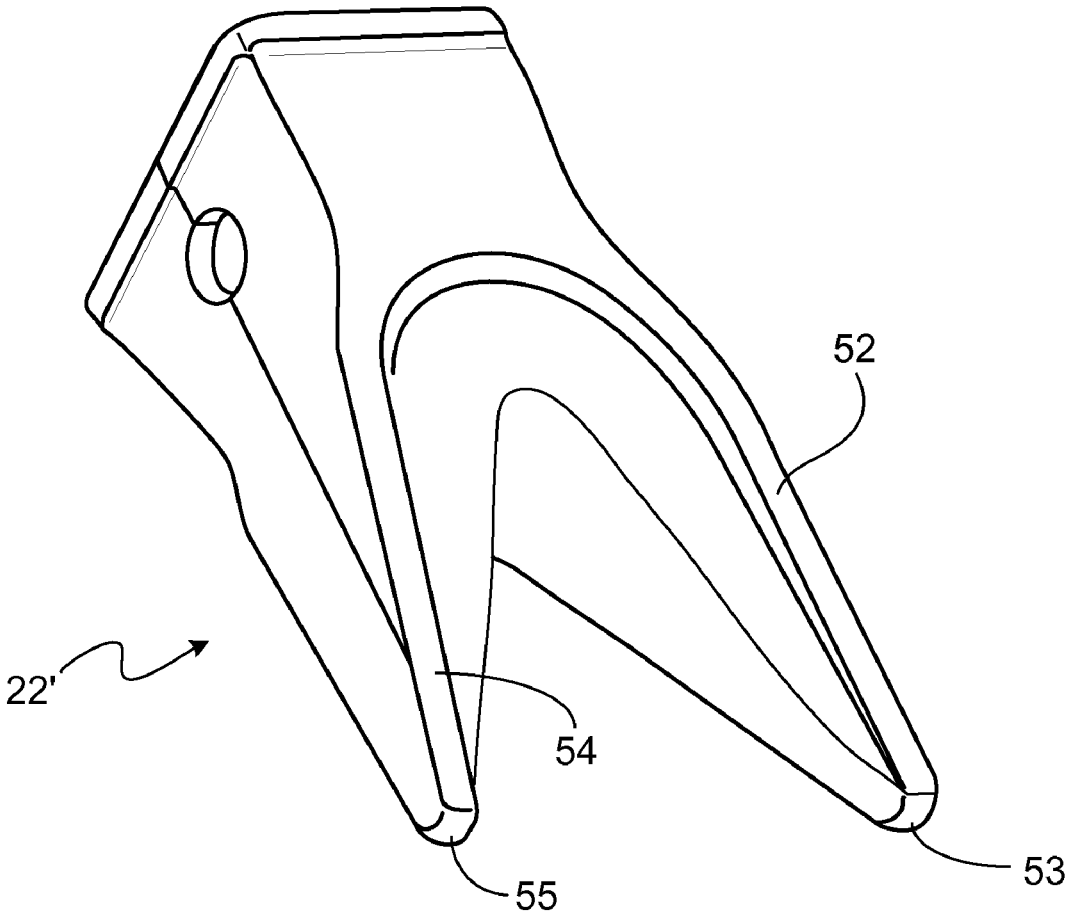
FIGS. 6, 7 and 8 are top perspective, first side and opposite second side views, respectively, of a double point ripper tooth, e.g. for use in the single pointed ripper bucket of FIG. 1.
Figure 7:
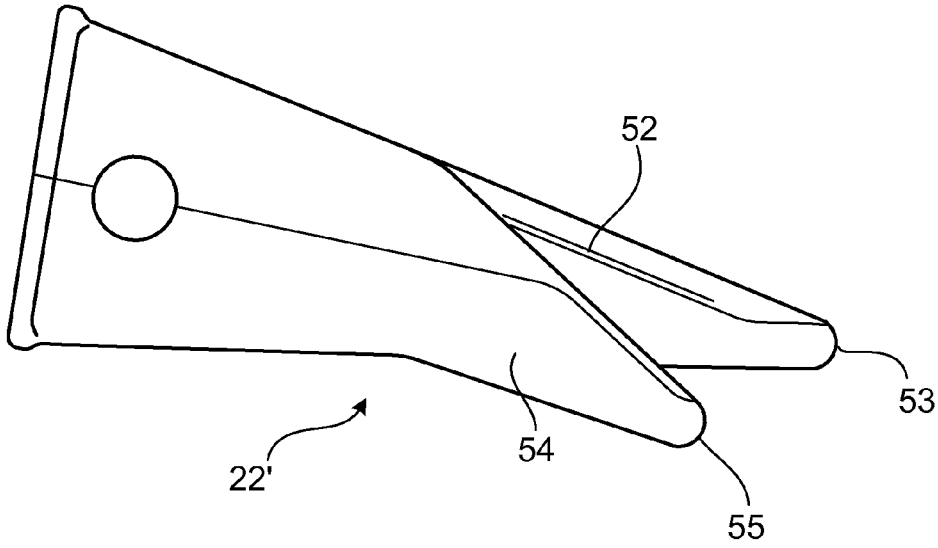
Figure 8:
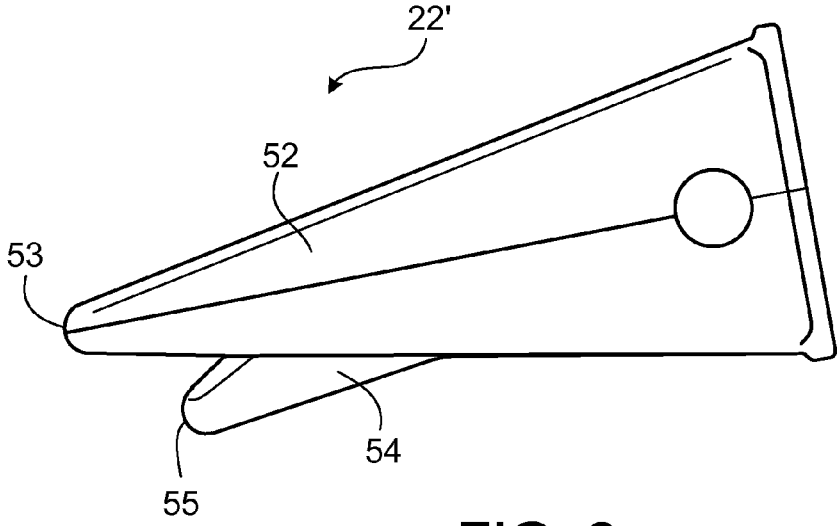
Figure 9:
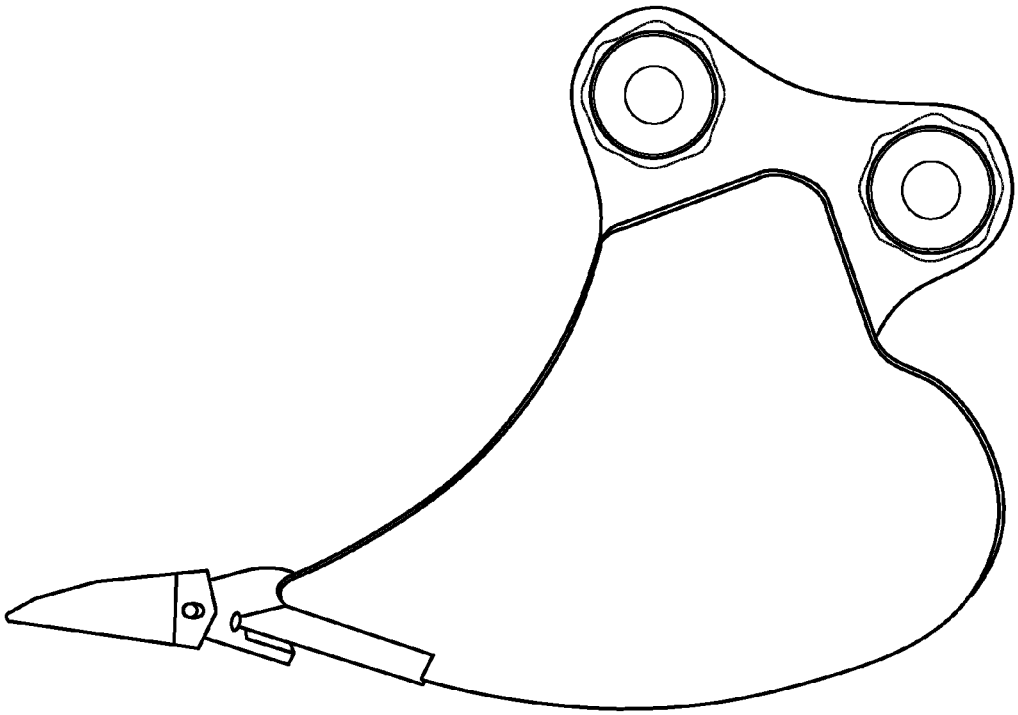
FIGS. 9, 10 and 11 are side, side perspective and front perspective photographs of a single pointed ripper bucket of the disclosure.
Figure 10:
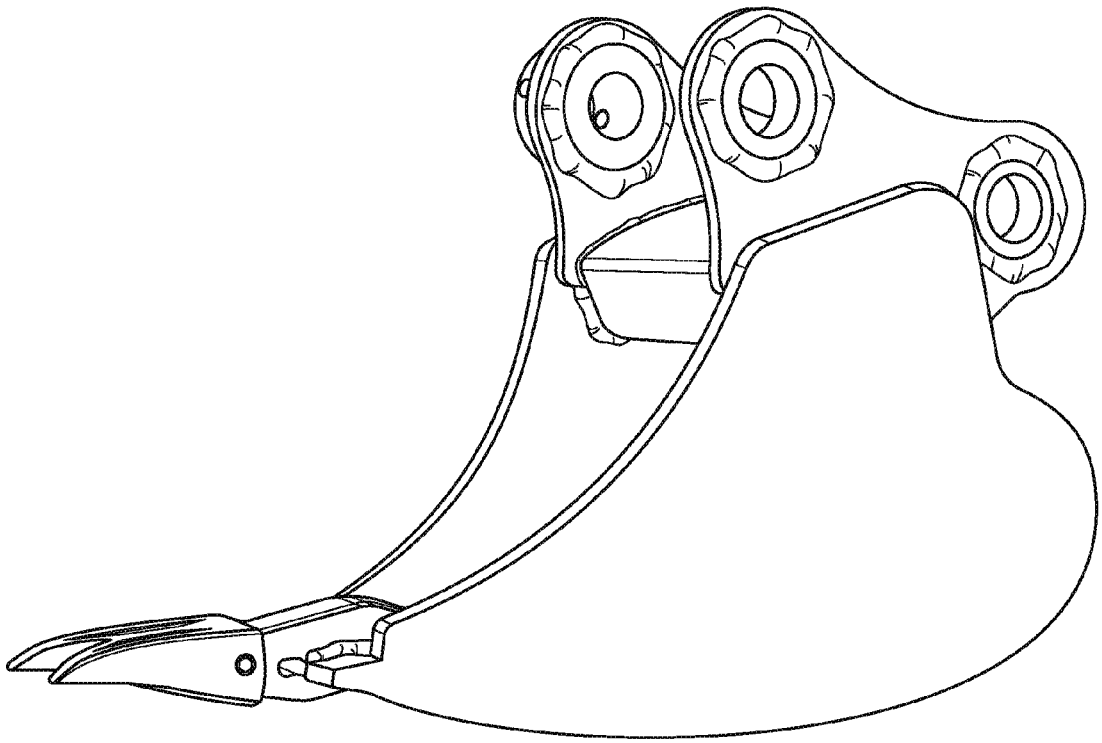
Figure 11:
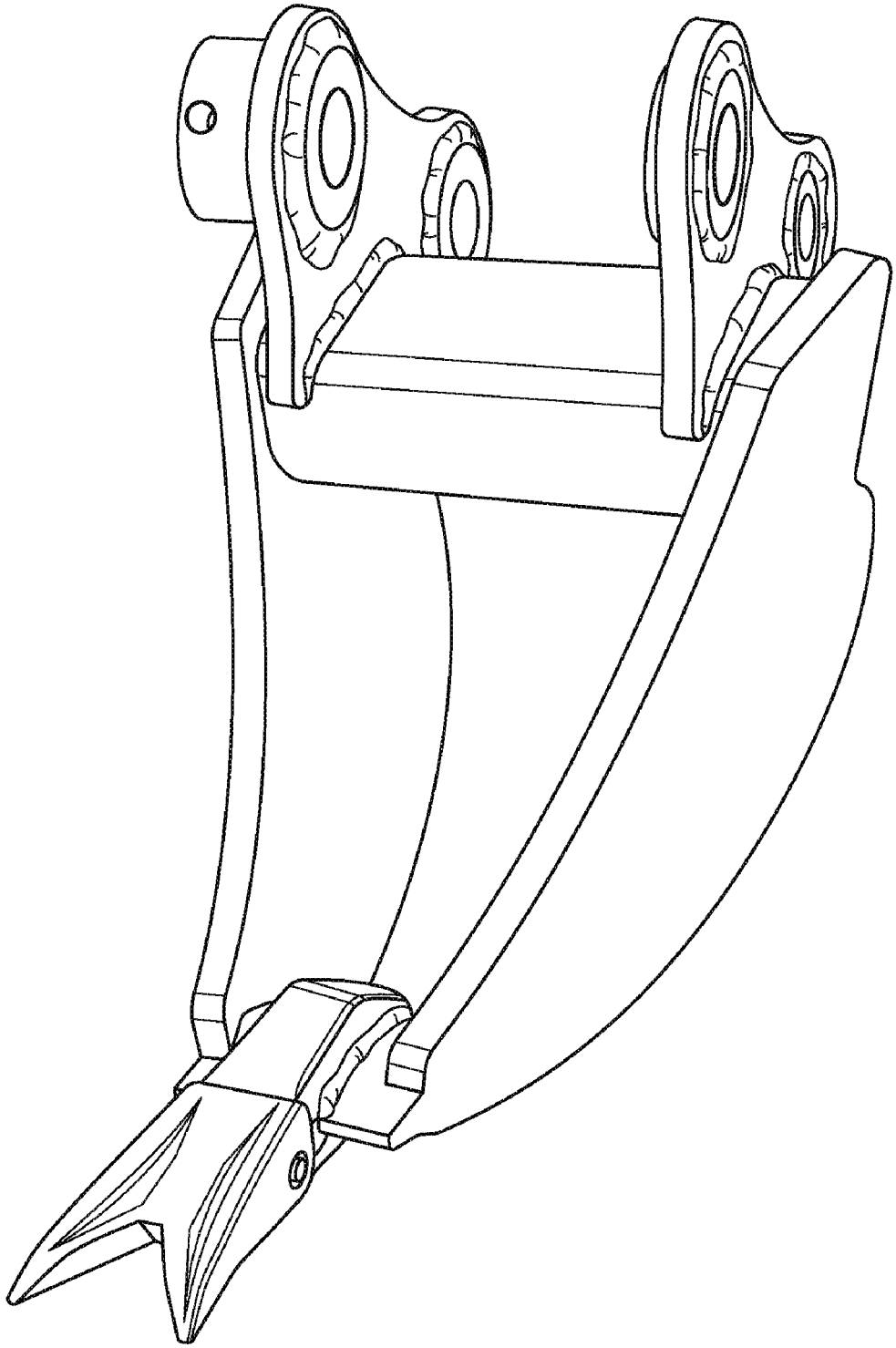
Figure 15:
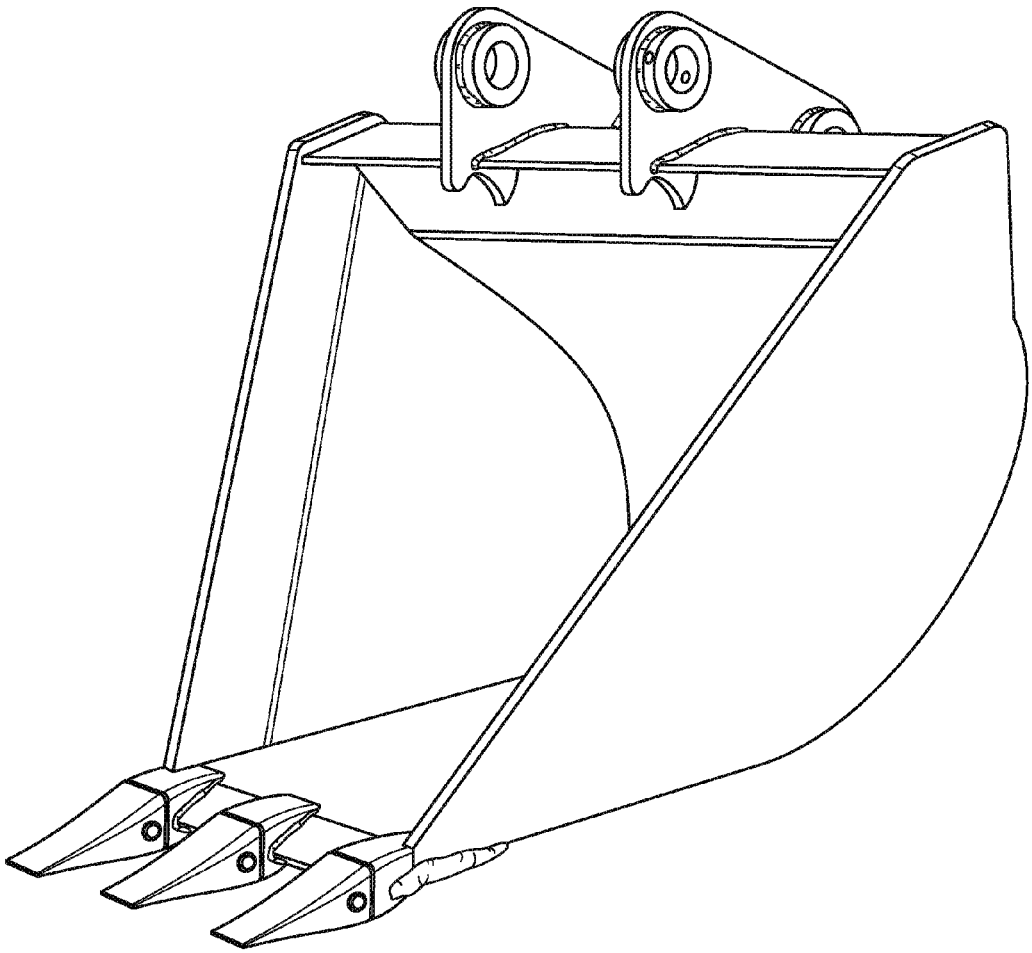
PRIOR ART FIG. 15
FIG. 15 is a front perspective view of another prior art trapezoidal "V" bucket (TVB) with teeth.
Figure 16A:
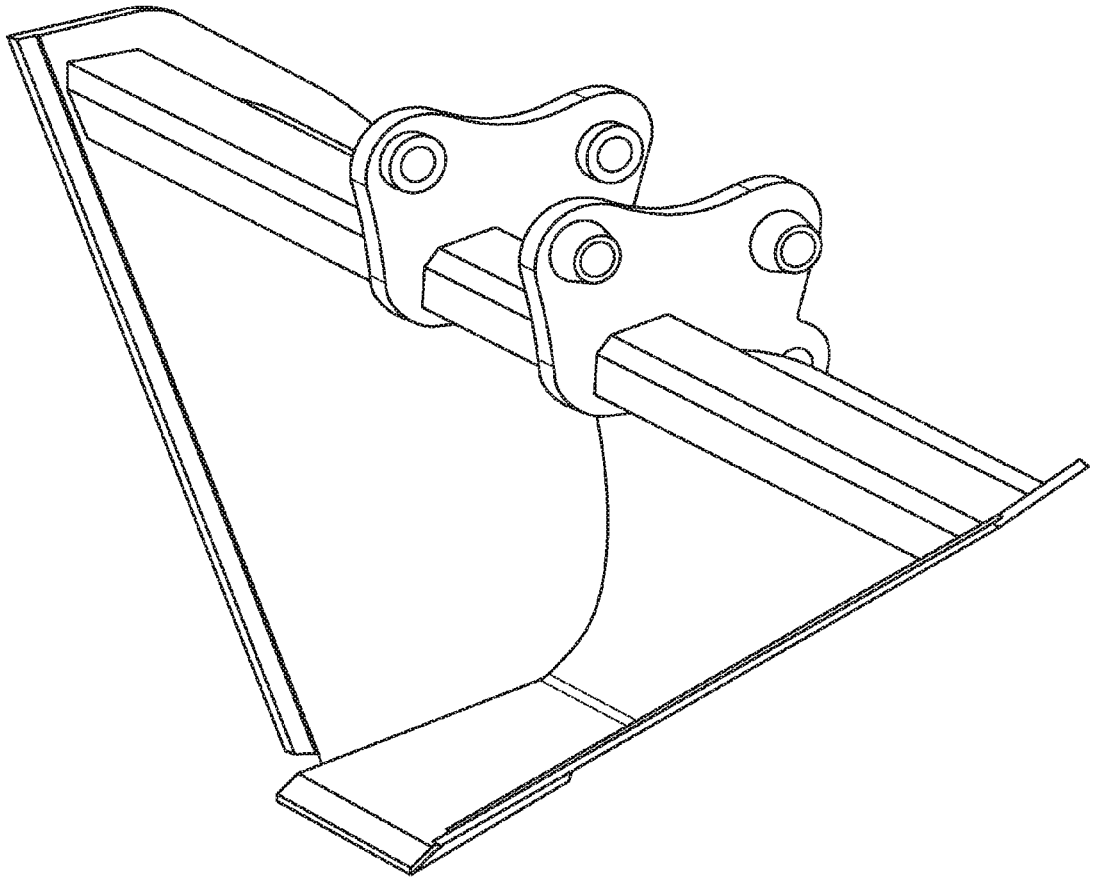
PRIOR ART FIG. 16A
FIGS. 16A and 16B are front and rear views, respectively, of a prior art trapezoidal "V" ditching bucket (TVB) without teeth.
Figure 16B:
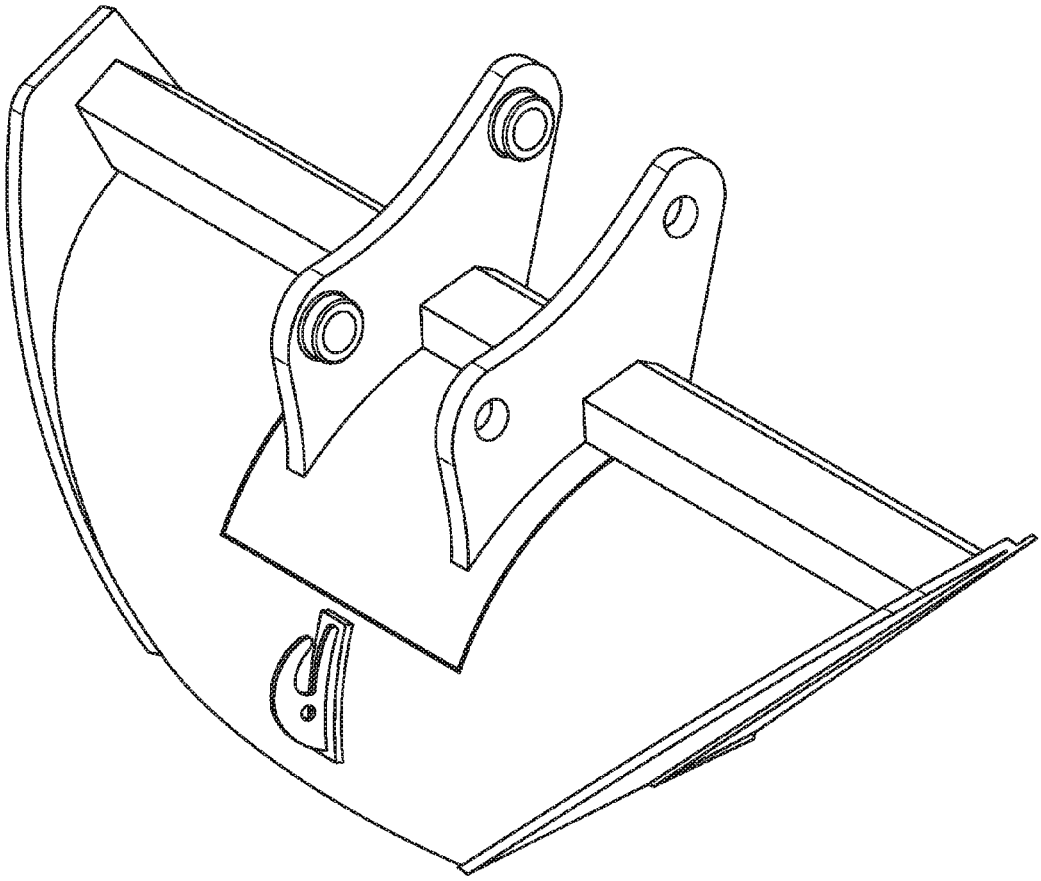
PRIOR ART FIG. 16B
Figure 17:
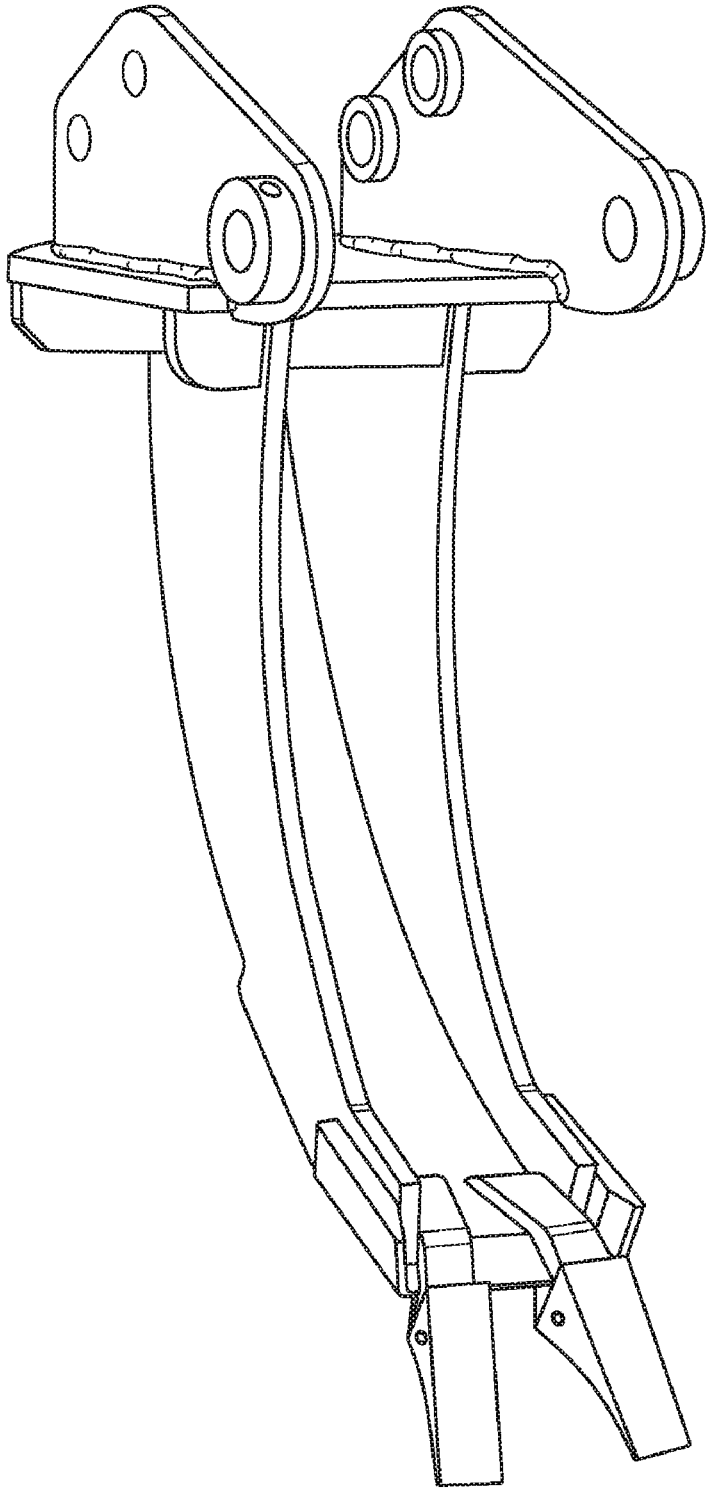
PRIOR ART FIG. 17
FIG. 17 is a front perspective view of a prior art railroad cribbing bucket (CB).
Figure 18:
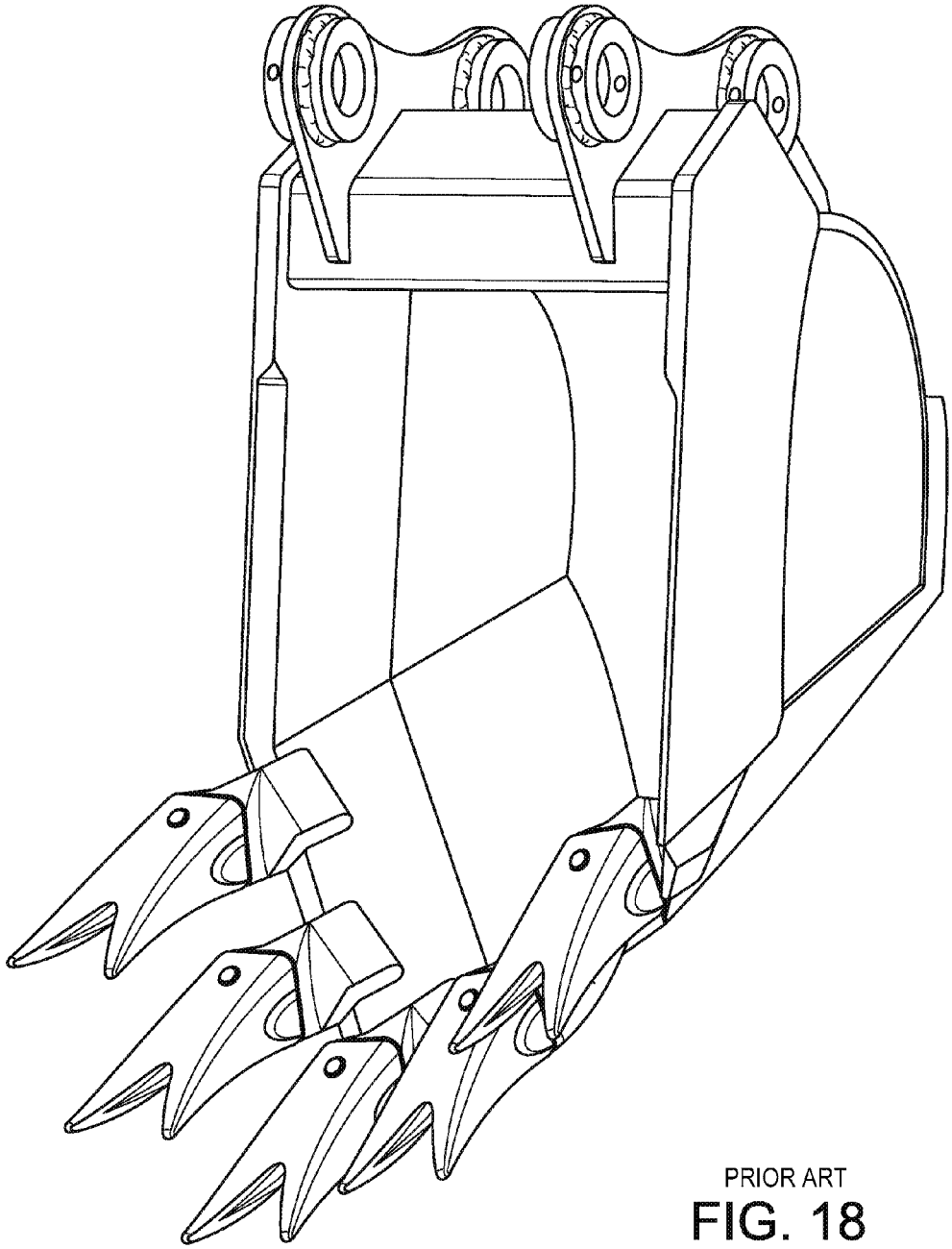
PRIOR ART FIG. 18
FIG. 18 is a front perspective view of a prior art strata "V" rock bucket (SVRB).

Novel features of the single pointed ripper bucket 10 include the following:

The ripper bucket 10 has a single tooth 22, and the tooth is preferably replaceable with a wide range of different tooth tip designs, including single points (e.g., as seen in FIGS. 12, 15 and 17) or multiple points (e.g., as seen in FIGS. 1-5). In another implementation, e.g., as shown in FIGS. 6-8, the single ripper tooth 22' is a double point ripper tooth having a first ripper tooth portion 52 and a second ripper tooth portion 54, the first ripper tooth portion being angularly advanced relative to the second ripper tooth portion in a general direction of substrate ripping motion, whereby the first ripper tooth tip 53 is engaged for ripping the substrate before the second ripper tooth tip 55 is engaged for ripping the substrate. The use of a single tooth and single tooth adapter assures that all of the breakout force is focused on a single tooth, thus creating a high point contact. Operating with a single tooth is also relatively less expensive.

The overall width of the single pointed ripper bucket 10 at the top (in the region of the body 16) is relatively narrow, but yet wide enough to be outside of the arm and linkage connection structure. The narrow top reduces the possibility that the structural side plates 12, 14 will warp or fail during ripping or prying.

The bottom surface 26 follows a curve having its center near the bucket arm pivot. The ripper bucket bottom being within this radius ensures that bottom surface of the ripper bucket clears un-ripped material during rotation of the ripper bucket 10 about the arm pivot, while having the ripper bucket bottom surface 26 follow relatively closely to the radius maximizes the capacity of the bucket. This curved shape of the bucket bottom surface 26 also creates a heel that clears the un-ripped material, while also providing sufficient structure to serve as a prying fulcrum against the ground surface, e.g., to pry out a stump or boulder.

The front leading edges 13, 15 of the side plates 12, 14 are curved in an upward concave shape, which causes material to be displaced upwards, relieving the material, when the ripper bucket 10 is used for ripping through hard rock or frost, rather than sideways, which could cause binding or compression of the material. This curved shape also allows the point of the ripper bucket (in the region of the tooth 22) to be narrow and thin so that the operator can insert the tip beneath a boulder or stump for prying. An operator, by rolling the ripper bucket 10 forward, thus pinching a boulder or stump between the bucket side leading edges 13, 15 and the arm of the machine, and employing the curved shape of the ripper bucket 10, can more easily cup and/or transport the boulder or stump.

The tooth adapter 20 may be a one- or two-strap adapter type mounted upon the narrow horizontal front leading edge 24 of the single pointed ripper bucket 10, or it can be a weld-on nosepiece adapter type welded on the end of a curved center shank. To facilitate ripping of rock and frozen ground, the tooth adapter 20 is preferably mounted such that the tooth 22 forms an angle in the range of between about 30° and 70° rearward from the line between the tooth tip or tips 23 and the bucket arm pivot.

For torsion strength, the upper structure 16 may be constructed of a horizontal cross tube 18 that is connected to the linkage ears or to the coupler connection that attaches to the excavator or backhoe linkage arm.

A number of embodiments of the invention have been described. Nevertheless, it will be understood that various modifications may be made without departing from the spirit and scope of the invention. For example, the side leading edges 13, 15, of the single pointed ripper bucket 10 may be fitted with replaceable bolt-on or weld-on side cutters for severe applications. Accordingly, other embodiments are within the scope of the following claims.

What is claimed is:

1. A single pointed ripper bucket excavation tool for use mounted to an arm of an excavation machine, said single pointed ripper bucket excavation tool comprising:

a tube structure mounted for rotation from the arm, a pair of generally flat, side plates mounted to the tube structure and narrowing from a first width in a region of the tube structure to a second, relatively smaller width at a tip region spaced from the tube structure, said pair of generally flat, side plates narrowing at an angle of between about 20° and about 40°, a single ripper tooth mounted in the tip region of the ripper bucket, and one or more plate members mounted to span a region between said side plates, rearward of said single ripper tooth in a direction of ripping motion, and defining, with said side plates, a ripper bucket volume for receiving material ripped from the substrate during ripping motion;

wherein said single pointed ripper bucket excavation tool has only one single ripper tooth, said single ripper tooth being mounted in the tip region of the ripper bucket;

wherein the ripper bucket defines a bottom surface generally following a curve having its center near the ripper bucket arm pivot; and wherein the side plates define front leading edges that curve in an upward concave shape angled rearwardly, away from the arm pivot radial centerline.

2. The single pointed ripper bucket excavation tool of claim 1, wherein said single ripper tooth terminates in a tip, and said single ripper tooth is disposed at a predetermined angle measured rearward from the line between the tooth tip and the bucket arm pivot, said predetermined angle being in a range of between about 30° and about 70°.

3. The single pointed ripper bucket excavation tool of claim 1, wherein said single ripper tooth is a double point ripper tooth having a first ripper tooth portion and a second ripper tooth portion, said first ripper tooth portion being angularly advanced relative to said second ripper tooth portion in a general direction of substrate ripping motion, whereby said first ripper tooth tip is engaged for ripping the substrate before said second ripper tooth tip is engaged for ripping the substrate.

4. The single pointed ripper bucket excavation tool of claim 1, said pair of generally flat, side plates narrowing at an angle of about 30°.

* * * * *

UNITED STATES PATENT AND TRADEMARK OFFICE

CERTIFICATE OF CORRECTION

PATENT NO. : 7,992,329 B2
APPLICATION NO. : 12/882820
DATED : August 9, 2011
INVENTOR(S) : Lee A. Horton It is certified that error appears in the above-identified patent and that said Letters Patent is hereby corrected as shown below:

Column 1, lines 14-15, delete “now abandoned”.

Column 1, lines 18-19, delete “2003, now abandoned.” and insert -- 2003. --.

Signed and Sealed this
Twenty-first Day of February, 2012

David J. Kappos

David J. Kappos
*Director of the United States Patent and Trademark Office*